US011434886B2

(12) United States Patent
Park et al.

(10) Patent No.: US 11,434,886 B2
(45) Date of Patent: Sep. 6, 2022

(54) LINEAR COMPRESSOR AND METHOD FOR CONTROLLING THE SAME

(71) Applicant: LG Electronics Inc., Seoul (KR)

(72) Inventors: Daegeun Park, Seoul (KR); Nayi Ryu, Seoul (KR); Sungjin Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/703,491

(22) Filed: Dec. 4, 2019

(65) Prior Publication Data

US 2020/0182231 A1 Jun. 11, 2020

(30) Foreign Application Priority Data

Dec. 5, 2018 (KR) ..... 10-2018-0155426

(51) Int. Cl.
*F04B 35/04* (2006.01)
*F04B 17/04* (2006.01)

(52) U.S. Cl.
CPC ..... *F04B 35/04* (2013.01); *F04B 17/04* (2013.01); *F04B 2201/0201* (2013.01); *F04B 2203/0401* (2013.01); *F04B 2203/0402* (2013.01); *F04B 2203/0404* (2013.01); *F25B 2400/073* (2013.01)

(58) Field of Classification Search
CPC .. F04B 35/04; F04B 17/04; F04B 2201/0201; F04B 2203/0401; F04B 2203/0402; F04B 2203/0404; F25B 2400/73
See application file for complete search history.

(56) References Cited

U.S. PATENT DOCUMENTS 6,753,665 B2 * 6/2004 Ueda ..... F04B 35/045 318/135
6,832,898 B2 * 12/2004 Yoshida ..... F04B 35/045 417/44.11
7,405,529 B2 * 7/2008 Kim ..... F04B 35/045 318/119
10,408,209 B2 * 9/2019 Ryu ..... F04B 39/0005
(Continued)

FOREIGN PATENT DOCUMENTS

CN 1346937 5/2002
CN 101094990 12/2007
(Continued)

OTHER PUBLICATIONS

German Office Action in German Application No. 10 2019 218 777.3, dated Sep. 10, 2020, 10 pages.
(Continued)

*Primary Examiner* — Christopher S Bobish
(74) *Attorney, Agent, or Firm* — Fish & Richardson P.C.

(57) ABSTRACT

A linear compressor includes, a cylinder, a piston configured to reciprocate inside the cylinder, a motor configured to supply driving force to the piston, a detector configured to detect a motor current and a motor voltage that are applied to the motor, and a controller configured to estimate a stroke of the piston based on the motor current and the motor voltage and to determine a phase difference between the stroke and the motor current. The controller is configured to detect operation information of the linear compressor, determine whether to perform a resonance operation based on the operation information, and control operation of the motor to allow the phase difference to be within a preset phase range.

20 Claims, 8 Drawing Sheets

(56) References Cited

U.S. PATENT DOCUMENTS

| | | | | |
|---|---|---|---|---|
| 10,436,191 | B2 * | 10/2019 | Ryu | F25B 49/022 |
| 2005/0271526 | A1 * | 12/2005 | Chang | F04B 35/045 417/417 |
| 2007/0241698 | A1 * | 10/2007 | Sung | F04B 35/045 318/135 |
| 2015/0071792 | A1 * | 3/2015 | Dainez | H02P 25/06 417/44.11 |
| 2020/0195119 | A1 * | 6/2020 | Suzuki | H02K 41/033 |

FOREIGN PATENT DOCUMENTS

| | | |
|---|---|---|
| CN | 101351758 | 1/2009 |
| CN | 101361262 | 2/2009 |
| CN | 104728074 | 6/2015 |
| CN | 105649966 | 6/2016 |
| CN | 108463634 | 8/2018 |
| DE | 102007016655 | 10/2007 |
| DE | 112004002954 | 6/2018 |
| DE | 112017004451 | 7/2019 |
| KR | 100386279 | 6/2003 |
| KR | 20150072167 | 6/2015 |
| KR | 1020150072167 | 6/2015 |
| KR | 20180087800 | 8/2018 |

OTHER PUBLICATIONS

Office Action in Chinese Appln. No. 201911226550.4, dated May 19, 2021, 11 pages (with English translation).
Office Action in Chinese Appln. No. 201911226550.4, dated Nov. 23, 2021, 20 pages (with English abstract).

* cited by examiner

LINEAR COMPRESSOR AND METHOD FOR CONTROLLING THE SAME

CROSS-REFERENCE TO RELATED APPLICATION

Pursuant to 35 U.S.C. § 119(a), this application claims the benefit of the earlier filing date and the right of priority to Korean Patent Application No. 10-2018-0155426, filed on Dec. 5, 2018, the contents of which are incorporated by reference herein in their entirety.

TECHNICAL FIELD

This disclosure relates to a linear compressor and a method for controlling the same.

BACKGROUND

A compressor is a component that can convert mechanical energy into compression energy of a compressive fluid and may be used as part of refrigeration equipment, for example, a refrigerator, an air conditioner, and the like.

Compressors may be classified into a reciprocating compressor, a rotary compressor, and a scroll compressor. In the reciprocating compressor, a compression space, in or from which working gas is suctioned or discharged, may be defined between a piston and a cylinder so that a refrigerant can be compressed while the piston is reciprocating in the cylinder. In the rotary compressor, a compression space, in or from which working gas is suctioned or discharged, may be defined between an eccentrically rotating roller and a cylinder so that a refrigerant can be compressed while the roller eccentrically rotates along an inner wall of the cylinder. In the scroll compressor, a compression space, in or from which working gas is suctioned or discharged, may be defined between an orbiting scroll and a fixed scroll so that a refrigerant can be compressed while the orbiting scroll rotates relative to the fixed scroll.

A reciprocating compressor may suction, compress, and discharge refrigerant gas by linearly reciprocating a piston inside a cylinder. Reciprocating compressors may be classified into a recipro type and a linear type according to a way of operating a piston.

The recipro type compressor may include a crankshaft coupled to a rotating motor and a piston coupled to the crankshaft, and convert a rotary motion of the motor into a linear reciprocating motion. The linear type compressor may include a piston connected to a mover of a linearly moving motor to make the piston reciprocate by virtue of the linear motion of the motor.

In some cases, a reciprocating compressor may include a motor unit generating driving force and a compression unit receiving the driving force from the motor unit to compress a fluid. For example, a motor may be used as the motor unit, and the linear type compressor may use a linear motor.

In some cases, the linear motor may not include a mechanical conversion device because the motor itself may directly generate a linear driving force, and thus its structure may not be complicated. In addition, the linear motor may reduce a loss due to energy conversion and reduce noise by virtue of absence of a connected portion where friction or wear can occur. In some cases, where a linear reciprocating compressor (hereinafter, referred to as a linear compressor) is used in a refrigerator or an air conditioner, a compression ratio can be changed by changing a stroke voltage applied to the linear compressor. Therefore, the linear compressor can also be used for a variable control of a freezing capacity of the refrigerator or a cooling capacity of the air conditioner.

In some cases, the linear compressor may follow a mass-spring (MK) resonant frequency in order to perform a resonance operation.

For instance, the MK resonant frequency may be defined by a mass M of a moving member including a piston and a permanent magnet and a spring constant K of springs supporting the moving member.

In some cases, a phase difference may occur between a stroke of a piston and a motor current of a linear compressor.

In some cases, when the phase difference between the stroke of the piston and the motor current of the linear compressor is a specific value, the linear compressor can operate at the highest efficiency.

A resonant phase may be defined as a phase difference between the stroke and the motor current, which allows the linear compressor to operate at the highest efficiency.

In some examples, when the phase difference between the motor current and the stroke always maintains the resonant phase, the linear compressor can achieve optimum efficiency.

However, the phase difference between the motor current and the stroke may be changed according to use environment of the linear compressor. This may cause deterioration of the efficiency of the linear compressor.

SUMMARY

The present disclosure describes a linear compressor that can be operated with a resonant phase by way of variably controlling an operating frequency of a motor.

The present disclosure also describes a linear compressor, capable of determining whether or not to perform a resonance operation according to an operating state thereof.

The present disclosure further describes a linear compressor, capable of performing a resonance operation or maintaining an operating frequency of a motor according to an external environment of an apparatus, which is provided with the linear compressor.

In some implementations, a control device for the linear compressor may vary an operating frequency so that a phase difference between a motor current and a stroke is a resonant phase when the phase difference between the motor current and the stroke is not the resonant phase.

According to one aspect of the subject matter, a linear compressor includes, a cylinder, a piston configured to reciprocate inside the cylinder, a motor configured to supply driving force to the piston, a detector configured to detect a motor current and a motor voltage that are applied to the motor, and a controller configured to estimate a stroke of the piston based on the motor current and the motor voltage and to determine a phase difference between the stroke and the motor current. The controller is configured to detect operation information of the linear compressor, determine whether to perform a resonance operation based on the operation information, and control operation of the motor to allow the phase difference to be within a preset phase range.

Implementations according to this aspect may include one or more of the following features. For example, the operation information of the linear compressor may include at least one of information related to the motor current, information related to the motor voltage, information related to an operation mode of the linear compressor, information related to a load applied to an apparatus having the linear compressor, or information related to a motion of the piston.

In some implementations, the controller may be configured to: determine whether a capacity of the linear compressor is variably set; and set an operating frequency of the motor for the resonance operation based on determining that the capacity of the linear compressor is variably set. In some implementations, the controller may be configured to: determine whether a capacity of the linear compressor is variably set; and based on determining that the capacity of the linear compressor is not variably set, maintain an operating frequency of the motor at a maximum frequency or increase the operating frequency of the motor to the maximum frequency.

In some implementations, the controller may be configured to: receive, from the apparatus having the linear compressor, information related to a load magnitude corresponding to the load applied to the apparatus; and set an operating frequency of the motor for the resonance operation based on the load magnitude being less than a preset reference load value. In some implementations, the controller may be configured to: receive, the apparatus having the linear compressor, information related to a load magnitude corresponding to the load applied to the apparatus; and increase an operating frequency of the motor to a preset reference frequency or higher based on the load magnitude being greater than or equal to a preset reference load value.

In some implementations, the controller may be configured to: monitor a change of at least one of the motor current or the motor voltage; and set an operating frequency of the motor for the resonance operation based on the change of the at least one of the motor current or the motor voltage. In some implementations, the controller may be configured to: detect a distance between a top dead center of the piston at which the piston changes a direction of reciprocation and a discharge portion of the cylinder configured to discharge refrigerant; and set an operating frequency of the motor for the resonance operation based on the detected distance exceeding a preset limit distance.

In some implementations, the controller may be configured to: determine whether the motor current corresponds to an asymmetrical current with respect to a reference current or the motor voltage corresponds to an asymmetrical voltage with respect to a reference voltage; and based on determining that at least one of the asymmetrical current or the asymmetrical voltage is applied to the motor, terminate the resonance operation and maintain an operating frequency of the motor.

In some implementations, the controller may be configured to: determine whether the motor current corresponds to an asymmetrical current with respect to a reference current or the motor voltage corresponds to an asymmetrical voltage with respect to a reference voltage; and set an operating frequency of the motor for the resonance operation based on determining that the asymmetrical current and the asymmetrical voltage are not applied to the motor. In some implementations, the controller may be configured to, based on the operation information corresponding to a refrigerant recovery operation, terminate the resonance operation and maintain an operating frequency of the motor.

In some implementations, the controller may be configured to: determine an amount of refrigerant circulated by the linear compressor; and based on the amount of refrigerant being less than a reference refrigerant amount, terminate the resonance operation and maintain an operating frequency of the motor.

In some implementations, the controller may be configured to: based on the phase difference and the motor current, detect a top dead center of the piston at which the piston changes a direction of reciprocation; and based on detecting a position of the piston corresponding to the top dead center, terminate the resonance operation and maintain an operating frequency of the motor. In some examples, the controller may be configured to maintain the operating frequency of the motor for a predetermined time interval from a time point corresponding to the detection of the position of the piston corresponding to the top dead center.

In some implementations, the controller may be configured to: maintain an operating frequency of the motor for a predetermined time interval from a time point corresponding to a start of operation of the linear compressor; and based on an elapse of the predetermined time interval from the time point, variably set the operating frequency of the motor for the resonance operation. In some implementations, the controller may be configured to: receive, from the apparatus having the linear compressor, temperature information related to a temperature corresponding to a location where the apparatus is installed; and maintain an operating frequency of the motor based on determining, from the temperature information, that the temperature is less than or equal to a preset reference temperature.

In some implementations, the controller may be configured to: monitor a variation of the phase difference after the resonance operation is started; and vary the preset phase range according to the variation of the phase difference. In some examples, the controller may be configured to increase the preset phase range to a target phase range based on the variation of the phase difference corresponding to a value that is greater than or equal to a preset first reference variation value.

In some implementations, the controller may be configured to decrease the preset phase range to a target phase range based on the variation of the phase difference corresponding to a value that is less than or equal to a preset second reference variation value. In some examples, the controller may be configured to decrease the preset phase range to a target phase range based on the variation of the phase difference corresponding to a value that is less than a preset first reference variation value and exceeds a preset second reference variation value.

In some implementations, the control device for the linear compressor may vary an initial value of a piston so that a phase difference between a motor current and a stroke is a resonant phase when the phase difference between the motor current and the stroke is not the resonant phase.

In some implementations, the control device for the linear compressor may vary an operating frequency so that a phase difference between a motor current and a stroke is a resonant phase when the phase difference between the motor current and the stroke is not the resonant phase. The control device may vary an initial value of a piston so that the phase difference between the motor current and the stroke is the resonant phase when the operating frequency reaches an upper limit or a lower limit.

In some implementations, the linear compressor can be controlled to operate with a resonant phase by way of varying a frequency. Accordingly, a phase can change even by less power consumption, thereby enhancing compressor efficiency.

In addition, the linear compressor can be controlled to operate with a resonant phase by way of changing an initial value of a piston using an electric control, thereby enhancing compressor efficiency and overcoming a limit in a mechanical design.

In some implementations, the enhancement of the compressor efficiency can be maximized by varying a frequency to change a phase and changing an initial value of the piston when reaching a frequency change limit.

DETAILED DESCRIPTION

This specification may be applied to a control device of a linear compressor and a method of controlling the linear compressor. However, the disclosure disclosed in this specification is not limited thereto, but may also be applied to control devices and control methods for all existing compressor, motor control devices, motor control methods, noise testing devices for motors, and noise testing methods for motors.

In describing the present disclosure, if a detailed explanation for a related known function or construction is considered to unnecessarily divert the gist of the present disclosure, such explanation has been omitted but would be understood by those skilled in the art. It should be noted that the attached drawings are provided to facilitate understanding of the examples disclosed in this specification, and should not be construed as limiting the technical idea disclosed in this specification by the attached drawings.

Hereinafter, an example of a general recipro-type reciprocating compressor will be described, with reference to FIG. 1A.

In some implementations, a motor installed in the recipro type reciprocating compressor may be coupled to a crankshaft 1*a*, so as to switch a rotary motion of the motor into a linear reciprocating motion.

Figure 1A:
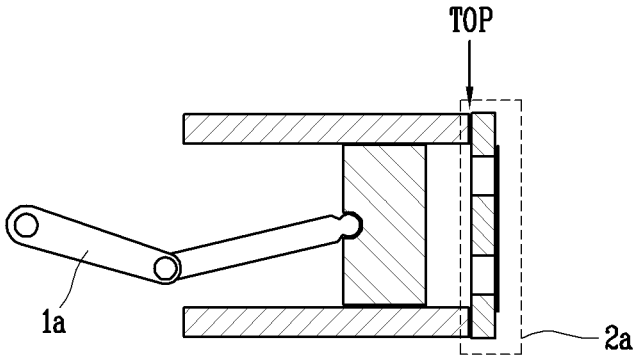
FIG. 1A is a conceptual view illustrating an example of a recipro-type reciprocating compressor.

As illustrated in FIG. 1A, a piston disposed in the recipro type reciprocating compressor may perform a linear reciprocating motion within a preset position range according to a configuration of the crankshaft or a configuration of a connecting rod connecting the piston and the crankshaft.

For example, when the specifications of the crankshaft and the connecting rod are decided within a range of a top dead center (TDC) in designing the recipro type compressor, the piston may not collide with a discharge unit 2*a* disposed on one end of the cylinder, even without applying a separate motor control algorithm. The TDC of the piston may refer to a position of the piston where the piston changes a direction of reciprocation.

In some examples, the discharge unit 2*a* may be disposed in the recipro type compressor and fixed to the cylinder. For example, the discharge unit 2*a* may be configured as a valve plate. The discharge unit 2*a* may be configured to discharge refrigerant from a compression space defined in the cylinder based on reciprocation of the piston.

In some cases, the recipro type compressor may generate friction among crankshaft, a connecting rod, and a piston, and thus may have more factors causing the friction than a linear type compressor to be explained later.

Hereinafter, an example of a general linear type reciprocating compressor will be described, with reference to FIG. 1A.

Figure 1B:
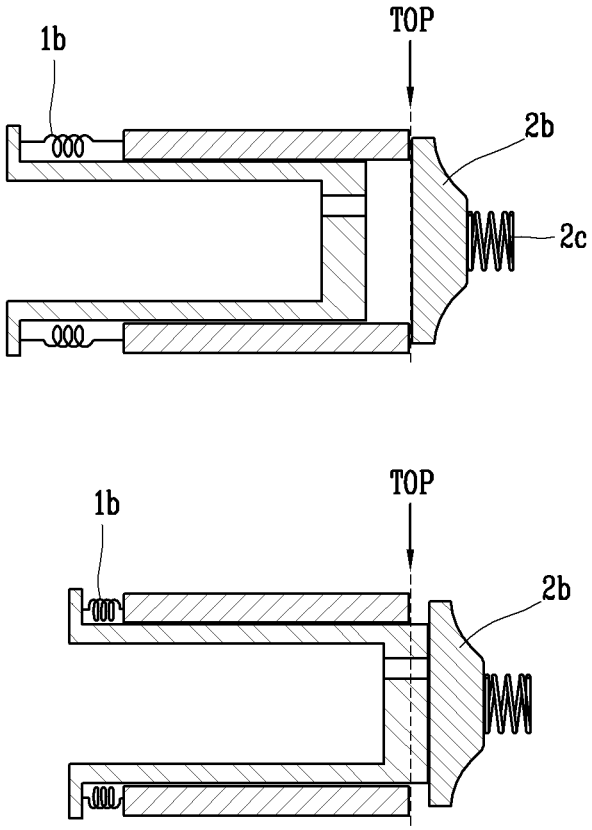
FIG. 1B is a conceptual view illustrating an example of a linear reciprocating compressor.

Comparing FIGS. 1A and 1B, unlike a recipro type of implementing a linear motion by a motor connected with a crankshaft and a connecting rod, a linear compressor may reciprocate a piston using a linear motion of a linearly-moving motor by connecting the piston to a mover of the motor.

As illustrated in FIG. 1B, an elastic member 1*b* may be connected between a cylinder and a piston of the linear type compressor. The piston may perform a linear reciprocating motion by a linear motor. A controller of the linear compressor may control the linear motor for switching a motion direction of the piston.

In more detail, the controller of the linear compressor illustrated in FIG. 1B may determine a time point that the piston collides with the discharge unit 2*b* as a time point that the piston reaches a TDC, and accordingly control the linear motor for switching the motion direction of the piston.

Hereinafter, components for controlling the operation of the linear compressor will be described.

Figure 2:
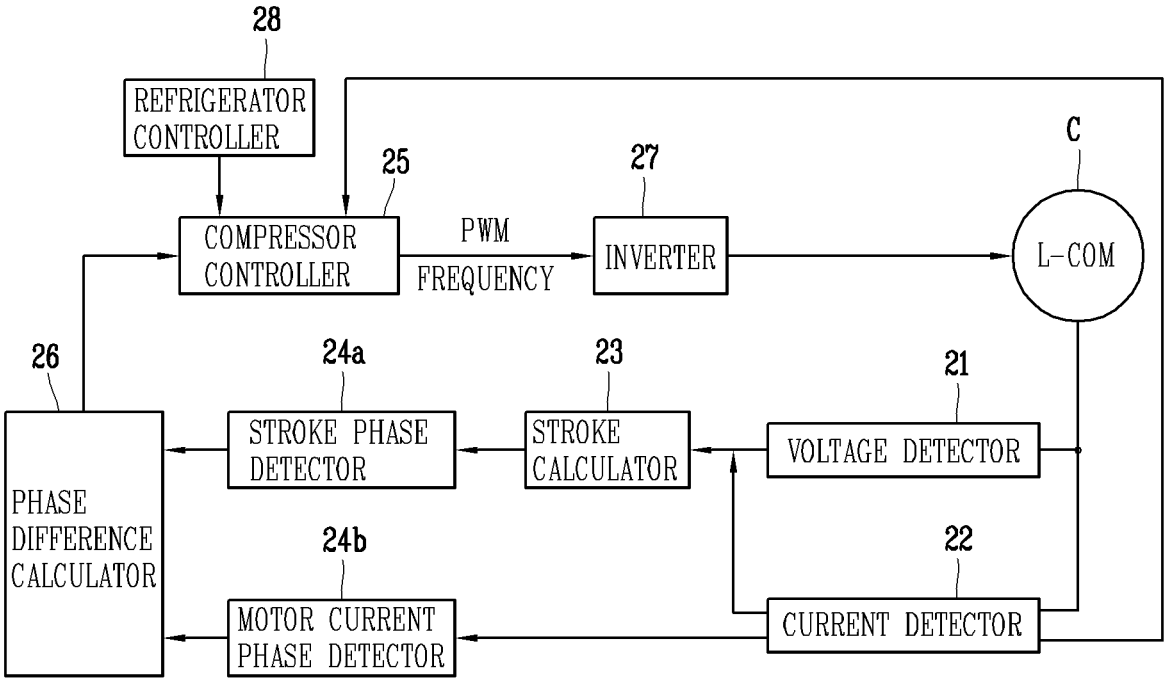
FIG. 2 is a block diagram illustrating example components of a linear compressor.

As illustrated in FIG. 2, the linear compressor may include a voltage detector 21, a current detector 22, a stroke calculator 23, a stroke phase detector 24*a*, a motor current phase detector 24*b*, a phase difference calculator 26, an inverter 27, and a controller 25.

In some implementations, the controller 25 is defined as a component that generates various control commands related to operations of the linear compressor. Therefore, the controller 25 may be configured separately from a control device 28 of an electronic apparatus (e.g., a refrigerator) provided with the linear compressor. For example, the controller 25 may include one or more of an electric circuit, an integrated chip, a microcomputer, a computer, or the like.

In some cases, the controller 25 may include one or more of the voltage detector 21, the current detector 22, the stroke calculator 23, the stroke phase detector 24*a*, the motor current phase detector 24*b*, and the phase difference calculator 26. In some cases, the controller 25 may be an independent component.

The voltage detector 21 may detect a motor voltage applied to the motor, and the current detector 22 may detect a motor current flowing through the motor. For example, the voltage detector 21 may include a voltage sensor, and the current detector 22 may include current sensor.

The stroke calculator 23 may calculate a stroke of a piston using the motor current and the motor voltage. The stroke calculator 23 may be a component substantially the same as the controller 25. For example, the controller 25 may include the stroke calculator 23 in some cases. In some cases, the stroke calculator 23 may be a separate control device including an electric circuit or an integrated chip.

The stroke calculator 23 may calculate a stroke estimation value using the following Equation 1, for example.

$$x = \frac{1}{\alpha}\int\left(V_m - Ri_m - L\frac{di_m}{dt}\right)dt \qquad \text{[Equation 1]}$$

Here, x denotes a stroke, a denotes a motor constant or counter electromotive force, $V_m$ denotes a motor voltage, $i_m$ denotes a motor current, R denotes resistance, and L denotes inductance.

The controller 25 may compare a stroke command value set according to an operation mode of the linear compressor with the stroke estimation value calculated by Equation 1, and control the stroke by varying the voltage applied to the motor based on the comparison result.

That is, the controller 25 decreases the motor voltage when the stroke estimation value is greater than the stroke command value, while increasing the motor voltage when the stroke estimation value is smaller than the stroke command value.

Referring to FIG. 2, the stroke phase detector 24*a* may detect a phase of a stroke, and the motor current phase detector 24*b* may detect a phase of a motor current. In addition, the phase difference calculator 26 may detect a phase difference between the stroke and the motor current. For reference, the stroke phase detector 24*a*, the motor current phase detector 24*b*, and the phase difference calculator 26 may be components substantially the same as the controller 25.

That is, the controller 25 may estimate a stroke of the piston using a motor current and a motor voltage, and calculate a phase difference between the stroke and the motor current.

In some implementations, the controller 25 may receive information related to an operation of the electronic apparatus (e.g., refrigerator), which is provided with the linear compressor, from the control device 28 of the electronic apparatus. For example, the information related to the operation of the electronic apparatus may include temperature information, operation mode information related to the electronic apparatus, and load information related to the electronic apparatus, all of which are processed by the electronic apparatus itself.

The controller 25 may control the linear compressor to operate in any one of a plurality of operation modes by using information received from the control device 28 of the electronic apparatus. The controller 25 may operate the motor by controlling a switching operation of the inverter 27.

Figure 3:
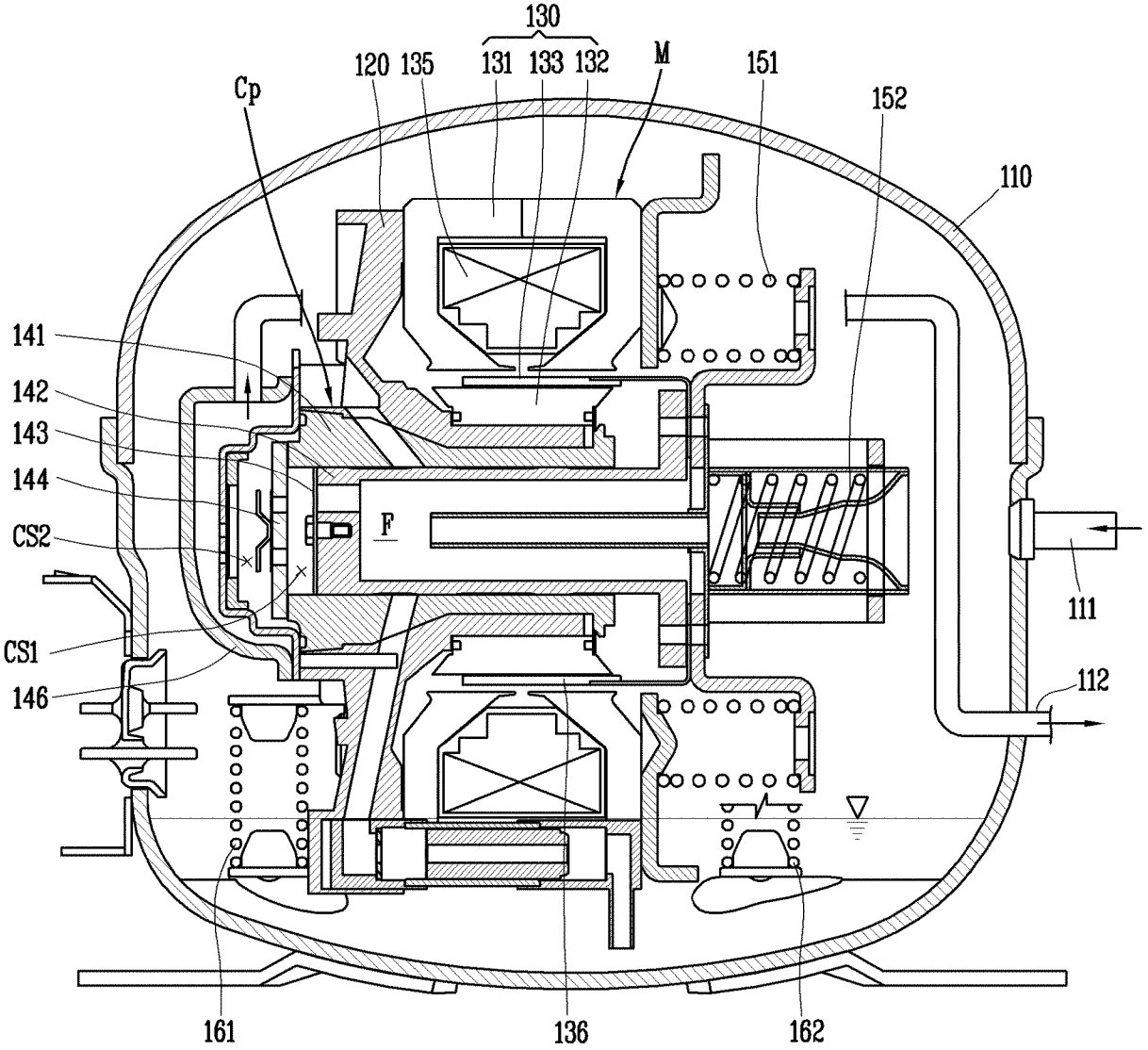
FIG. 3 is a sectional view illustrating an example of a linear compressor.

Hereinafter, FIG. 3 is a cross-sectional view showing an example of a compressor.

In some implementations, the linear compressor may be applied to any type or shape of linear compressor if a control device for a linear compressor or a control device for a compressor is applicable thereto. The linear compressor illustrated in FIG. 3 is merely illustrative, and this disclosure may not be limited to this.

In some implementations, a motor applied to a compressor may include a stator with a winding coil and a mover with a magnet. The mover performs a rotary motion or reciprocating motion according to interaction between the winding coil and the magnet.

The winding coil may be configured in various forms according to a type of motor. For example, a winding coil of a rotary motor is wound on a plurality of slots, which is formed on an inner circumferential surface of a stator in a circumferential direction, in a concentrated or distributed manner. For a reciprocating motor, a winding coil is formed by winding a coil into a ring shape and a plurality of core sheets is inserted to an outer circumferential surface of the winding coil in a circumferential direction.

In some implementations, for the reciprocating motor, the winding coil may be formed by winding the coil into the ring shape. Thus, the winding coil is typically formed by winding the coil on an annular bobbin made of a plastic material.

As illustrated in FIG. 3, a reciprocating compressor includes a frame 120 disposed in an inner space of a hermetic shell 110 and elastically supported by a plurality of supporting springs 161 and 162. A suction pipe 111 which is connected to an evaporator of a refrigerating cycle is installed to communicate with the inner space of the shell 110, and a discharge pipe 112 which is connected to a condenser of the refrigerating cycle is disposed at one side of the suction pipe 111 to communicate with the inner space of the shell 110.

An outer stator 131 and an inner stator 132 of a reciprocating motor 130 which constitutes a motor unit M are fixed to the frame 120, and a mover 133 which performs a reciprocating motion is interposed between the outer stator 131 and the inner stator 132. A piston 142 constituting a compression unit Cp together with a cylinder 141 to be explained later is coupled to the mover 133 of the reciprocating motor 130.

The cylinder 141 is disposed in a range of overlapping the stators 131 and 132 of the reciprocating motor 130 in an axial direction. A compression space CS1 is formed in the cylinder 141. A suction passage F through which a refrigerant is guided into the compression space CS1 is formed in the piston 142. A suction valve 143 for opening and closing the suction passage F is disposed in an end of the suction passage F. A discharge valve 144 for opening and closing the compression space CS1 of the cylinder 141 is disposed on a front surface of the cylinder 141.

For reference, a discharge portion of the linear compressor disclosed herein may be implemented in various forms.

For example, the linear compressor disclosed herein may include a discharge portion formed of a valve plate, as shown in FIG. 3. That is, a discharge portion used in the related art recipro compressor may be applied to the linear compressor disclosed herein.

In another example, the linear compressor disclosed herein may include a discharge portion having an elastic member, as shown in FIG. 1B. That is, a discharge portion used in the existing linear compressor may also be applied to the linear compressor disclosed herein.

Referring to FIGS. 2 and 3, the controller 25 may control the motor to switch a motion direction of the piston 142.

For reference, the piston 142 of the linear compressor performs a linear reciprocating motion in the cylinder 141, so as to move in a direction toward the discharge valve 144 or in a direction away from the discharge valve 144.

The motion direction of the piston 142 performing the reciprocating motion is switched at two points. One of the two points which is closer to the discharge valve 144 is defined as a top dead center (TDC), and the other is defined as a bottom dead center (BDC). According to these definitions, a distance between the TDC and the BDC corresponds to a stroke of the piston.

The controller 25 may detect whether or not the piston has reached the TDC by using a stroke calculated by Equation 1 and a motor current and a motor voltage.

In some implementations, the controller 25 may determine whether or not the piston head reached the TDC by detecting a phase difference between a motor current measured by the current detector 22 and a stroke calculated by Equation 1, and monitoring changes in the phase difference.

In some implementations, the controller 25 may calculate the phase difference between the motor current and the stroke, and determine that the piston has reached the TDC when the phase difference forms an inflection point.

A magnetic flux may be formed in the coil of the motor. A total magnetic flux ΦT obtained by adding a first magnetic flux $\Phi_i$ generated by a current and a second magnetic flux $\Phi_m$ generated by a magnet of the motor may be formed in the coil.

The first magnetic flux $\Phi_i$ is calculated by the following Equation 2.

$$\vec{\Phi}_i = \mu_0 \frac{\sqrt{2}\,\vec{J} A_c}{2g} \pi DS \quad \text{[Equation 2]}$$

In addition, the second magnetic flux Φm is calculated by the following Equation 3.

$$\vec{\Phi}_m = \vec{B}_m \pi DS \quad \text{[Equation 3]}$$

In Equations 2 and 3, J denotes coil current density, $B_m$ denotes magnet flux density, D denotes a diameter of the coil, S denotes a stroke, $A_c$ denotes a total area of the coil, and g denotes an air-gap of the coil. Other parameters are constants, and thus description thereof is omitted.

Referring to the definitions of Equations 2 and 3, the first magnetic flux $\Phi_i$ is proportional to a magnitude of a current, and the second magnetic flux $\Phi_m$ is proportional to a magnitude of a stroke.

In some examples, as a difference between a phase of the first magnetic flux and a phase of the second magnetic flux decreases, a magnitude of the total magnetic flux ΦT may increase.

Therefore, this disclosure proposes a linear compressor which prevents magnetic flux saturation of the coil by increasing the difference between the phase of the first magnetic flux and the phase of the second magnetic flux when the magnetic flux saturation is highly likely to occur.

The controller 25 may variably set an operating frequency of the motor to prevent the magnetic flux saturation of the coil provided in the motor.

In some implementations, the controller 25 may set an operating frequency of the motor based on the phase difference between the motor current and the stroke, so that the magnitude of the magnetic flux formed in the coil is maintained below a preset limit magnetic flux value.

First, the controller 25 may determine whether an operation mode for preventing magnetic flux saturation is necessary, by using information related to an operating state of the linear compressor.

In some implementations, the controller 25 may detect a magnitude of a magnetic flux formed in the coil, and activate a protection mode for preventing magnetic flux saturation of the linear compressor based on the detected magnitude. For example, the controller 25 may detect the magnitude of the magnetic flux formed in the coil by using Equations 2 and 3 described above. When the detected magnitude of the magnetic flux exceeds a preset value, the controller 25 may activate the protection mode for preventing the magnetic flux saturation of the linear compressor.

The controller 25 may store a motor constant of the motor provided in the linear compressor in advance, and directly calculate the magnitude of the magnetic flux using the stored motor constant.

In some implementations, the controller 25 may calculate a parameter related to a magnitude of a magnetic flux and activate the protection mode based on the calculated parameter. For example, the controller 25 may calculate a parameter related to a distortion factor of a motor current. When a magnitude of the calculated parameter exceeds a preset value, the controller 25 may activate the protection mode for preventing the magnetic flux saturation of the linear compressor.

For example, the parameter related to the distortion factor may be a Crest Factor (CF). The controller 25 may calculate the crest factor by dividing the highest value of a motor current by an effective value or by dividing the highest value of a motor voltage by an effective value. When the detected crest factor exceeds a preset value, the controller 25 may activate the protection mode for preventing the magnetic flux saturation of the linear compressor.

In another example, the controller 25 may calculate an integral value of a motor voltage. When the calculated integral value is greater than a predetermined integral value, the controller 25 may activate the protection mode for preventing the magnetic flux saturation of the coil.

In some implementations, the controller 25 may activate the protection mode according to an operation mode in which the linear compressor is operating. In detail, the controller 25 may determine whether to perform a protection algorithm for preventing magnetic flux saturation according to an operation mode of the motor.

That is, the controller 25 may not directly calculate a magnetic flux, but may determine that there is a high possibility of magnetic flux saturation when the motor operates in a specific operation mode, so as to perform the protection algorithm.

In some implementations, the controller 25 may set an operating frequency of the motor by using a protection algorithm when the motor operates in a first operation mode and a distance between the TDC and BDC of the piston is greater than a preset distance.

The controller 25 may also set an operating frequency of the motor using a protection algorithm when the motor operates in a second operation mode and the TDC of the piston is formed within a predetermined distance from the discharge portion of the cylinder.

The controller 25 may also set an operating frequency of the motor using a protection algorithm when the motor operates in a third operation mode and an asymmetrical current is applied to the motor. For instance, the controller 25 may determine the asymmetrical current based on a reference current when the motor current has a magnitude greater in one side of the reference current than in the other side of the reference current.

In addition, the controller 25 may set an operating frequency of the motor by using a protection algorithm when a magnitude of a current applied to the motor is greater than a predetermined current value.

That is, the controller 25 may determine that there is a high possibility of magnetic flux saturation when the linear compressor operates in an operation mode corresponding to an overload. Therefore, when the linear compressor and its motor perform an operation corresponding to the overload, the controller 25 may set the operating frequency of the motor by using a protection algorithm for preventing the magnetic flux saturation.

In some implementations, the controller 25 may receive load information on an electronic apparatus, in which the linear compressor is mounted, from the electronic apparatus, and determine whether to perform the protection algorithm based on the received load information. For example, the controller 25 may receive load information related to a load change of a refrigerator, in which the linear compressor is mounted, from the refrigerator, and set an operating frequency of the motor using the protection algorithm when a load change amount drastically increases.

In some implementations, the controller 25 can determine whether to perform the protection mode for the magnetic flux saturation or the protection algorithm corresponding to the protection mode, by directly calculating a magnitude of a magnetic flux or identifying an operation mode of the linear compressor.

Hereinafter, a method of performing a protection algorithm will be described.

During a protection mode for preventing magnetic flux saturation, the controller 25 disclosed herein may calculate a phase difference between a stroke and a motor current, compare the calculated phase difference with a preset reference phase value, and set an operating frequency of the motor based on the comparison result.

In some implementations, the controller 25 may calculate a phase difference variable by subtracting the calculated phase difference from 180°. The controller 25 may compare the calculated phase difference variable with a preset reference phase value and change an operating frequency of the motor based on the comparison result.

In one example, the reference phase value may be set to 70°. The reference phase value may change according to a user setting, or may be variably set depending on an operating state of the linear compressor.

In addition, when the phase difference variable is greater than the reference phase value, the controller 25 may increase the operating frequency of the motor. In detail, the controller 25 may update a phase difference variable for each preset period, and increase an operating frequency of the motor whenever the updated phase difference variable is greater than a reference phase value.

That is, when a protection mode for preventing magnetic flux saturation is activated, the controller 25 may compare the phase difference variable with the preset reference phase value at the preset period, and increase the operating frequency of the motor by a predetermined range whenever the phase difference variable is greater than the reference phase value. For example, an increase range of the operating frequency may be set to 0.5 Hz.

In some implementations, the controller 25 may set the increase range of the operating frequency by using information related to correlation between the operating frequency and the phase difference variable. In this case, the correlation may be defined as an increase rate of the phase difference variable with respect to the operating frequency.

In some implementations, the controller 25 may monitor changes in magnetic flux formed in the coil provided in the motor, and change an increase range of an operating frequency of the motor based on the monitoring result. That is, the controller 25 may increase the increase range of the operating frequency when an increase amount of magnetic flux exceeds a specific value within a preset time interval.

As such, the controller 25 may change an operating frequency of the motor whenever a phase difference variable and a reference phase value are compared with each other, and may variably set a range for changing the operating frequency.

In some implementations, the reference phase value may be defined as an upper limit reference value of the phase difference variable, and the controller 25 may set a limit phase value defined as a lower limit reference value of the phase difference variable, separately from the reference phase value.

The controller 25 may decrease the operating frequency of the motor when the phase difference variable is smaller than the limit phase value. Similar to the increase range of the operating frequency, a decrease range of the operating frequency may be set variably.

Figure 4:
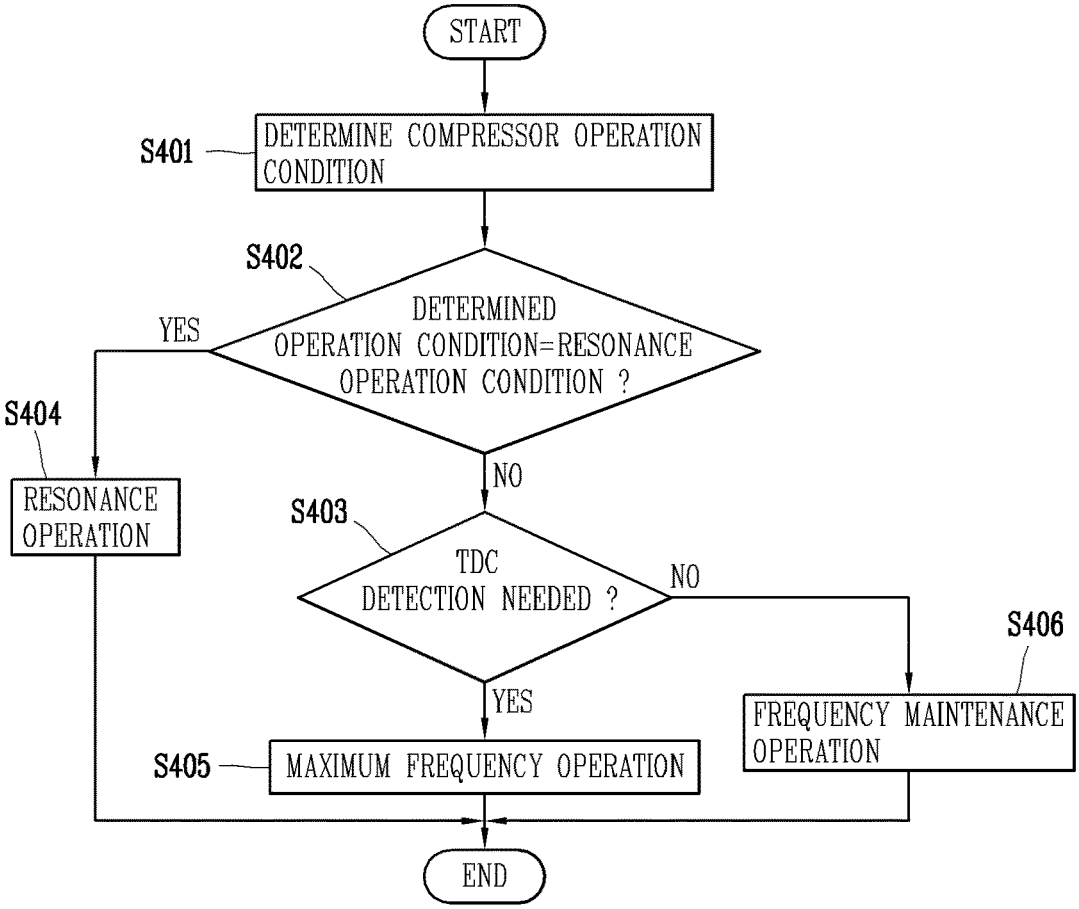
FIGS. 4-12 are flowcharts illustrating examples of a method for controlling a linear compressor.

FIG. 4 is a flowchart illustrating an example method for controlling a linear compressor disclosed herein.

Referring to FIG. 4, the controller 25 may detect information related to an operation condition of the compressor (S401).

In detail, the controller 25 may detect identification information regarding an operation mode in which the linear compressor is operating. In addition, the controller 25 may detect identification information regarding an operation mode in which an electronic apparatus equipped with the linear compressor is operating.

In some implementations, the controller 25 may determine whether an operation mode currently activated in the compressor is an operation mode corresponding to overload. For example, the operation mode corresponding to the overload may be defined by including a first mode in which the piston reciprocates at the maximum stroke distance, a second mode in which an asymmetrical current is applied to the motor, and a third mode in which a motor current of a predetermined magnitude or larger is applied to the motor.

In addition, the controller 25 may determine whether an operation condition of the linear compressor satisfies a resonance operation condition, by using information related to the operation of the linear compressor (S402).

That is, the controller 25 may determine whether or not the linear compressor should perform a resonance operation, by using information related to the operation of the linear compressor. Depending on the determination as to whether the resonance operation should be performed, the controller 25 may control the linear compressor to perform the resonance operation or maintain an operating frequency of the motor.

As illustrated in FIG. 4, when it is determined that the resonance operation condition is satisfied, the controller 25 may variably set the operating frequency of the motor so that the linear compressor performs the resonance operation (S404).

In some example, where it is determined that the resonance operation condition is not satisfied, the controller 25 may determine whether or not it is necessary to detect a position where a TDC of the piston is formed, by using information related to the operation of the linear compressor (S403).

In some implementations, the controller 25 may determine whether an operation condition of the linear compressor satisfies a resonance operation condition, by using information related to the operation of the linear compressor. In this case, the information related to the operation of the linear compressor may include information related to at least one of a motor current, a motor voltage, a stroke command value, a position of the piston, a motion of the piston, and a freezing capacity of the compressor.

In some implementations, the controller 25 may determine whether an operation condition of the linear compressor satisfies a resonance operation condition, by using information received from a control device of a home appliance equipped with the linear compressor.

For example, the controller 25 may receive information related to at least one of a compressor operation command, external temperature, external humidity, and a load of a home appliance having the linear compressor, from a control device of the home appliance.

In this case, information related to an operation of the linear compressor may include at least one of information related to a motor current, information related to a motor voltage, information related to an operation mode of the linear compressor, information related to a load of the apparatus having the linear compressor, and information related to a motion of the piston.

When it is determined that the TDC position has been detected, the controller 25 may operate the motor at the maximum frequency (S405). On the other hand, when it is determined that the TDC position has not been detected, the controller 25 may maintain an operating frequency of the motor (S406).

Figure 5:
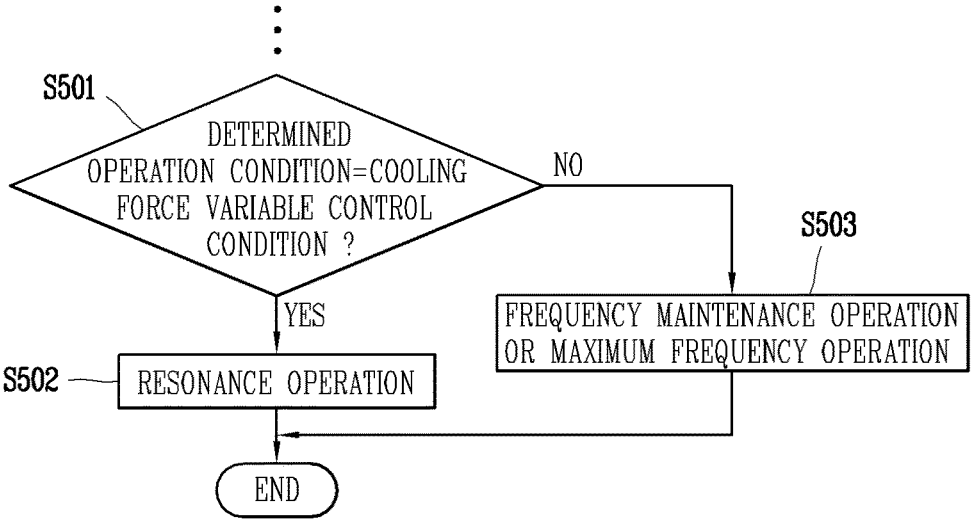

Referring to FIG. 5, in order to determine whether to perform a resonance operation, the controller 25 may determine whether the information related to the operation of the linear compressor satisfies a freezing capacity variable control condition of the linear compressor (S501). The controller 25 may perform the resonance operation when the freezing capacity variable control condition is satisfied (S502), and may perform a frequency maintenance operation or a maximum frequency operation when the freezing capacity variable control condition is not satisfied (S503).

Figure 6:
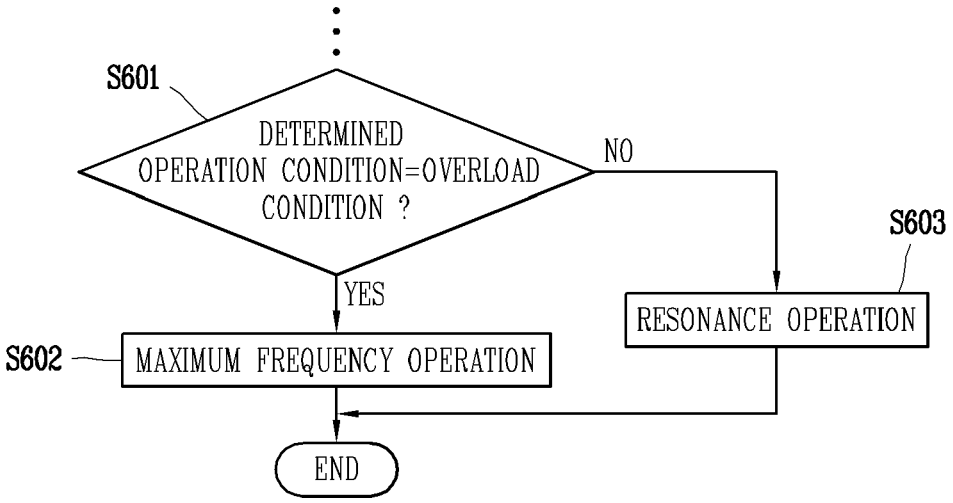

Referring to FIG. 6, in order to determine whether to perform a resonance operation, the controller 25 may determine whether the information related to the operation of the linear compressor satisfies an overload condition (S601).

For example, the controller 25 may increase the operating frequency of the motor to a preset value or higher when it is determined that a load variation of the apparatus having the linear compressor is greater than or equal to a predetermined degree (or predetermined value) or a load of the apparatus exceeds a limit load (S602). In some examples, the controller 25 may perform the resonance operation when the information does not satisfy the overload condition (S603).

Figure 7:
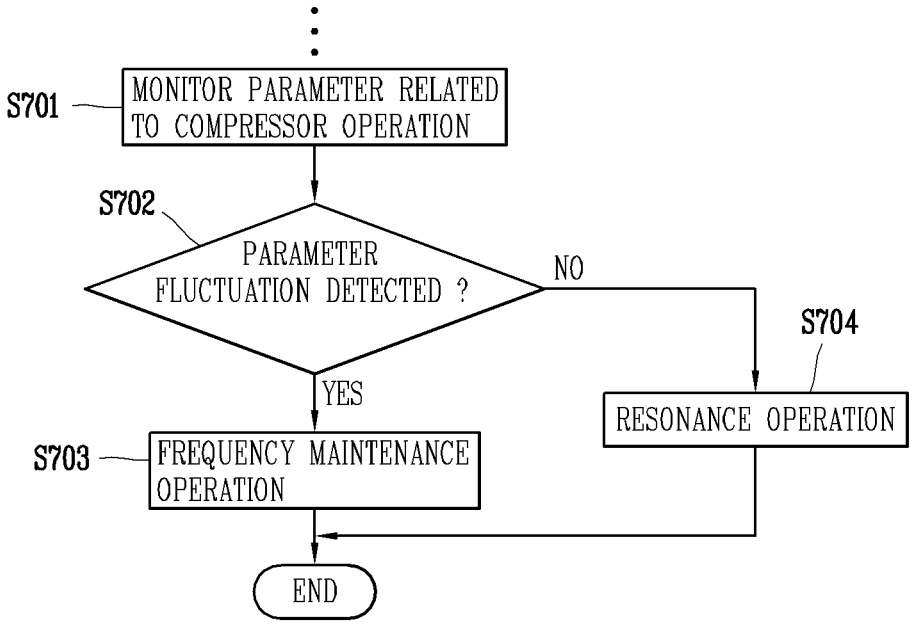

Referring to FIG. 7, the controller 25 may monitor a parameter related to an operation of the compressor (S701).

In some examples, when fluctuation of the parameter to be monitored is detected (S702), the controller 25 may terminate the resonance operation and start the frequency maintenance operation (S703).

In some examples, when such fluctuation of the parameter to be monitored is not detected, the controller 25 may perform the resonance operation (S704).

For example, the parameter related to the operation of the compressor may include at least one of a motor current, a motor voltage, a stroke, and a gas constant.

In some implementations, the controller 25 may monitor changes of at least one of a motor current and a motor voltage, and determine whether to perform the resonance operation based on the monitoring result. That is, when it is determined that the motor current and the motor voltage are excessively fluctuated, the controller 25 may terminate the resonance operation.

Figure 8:
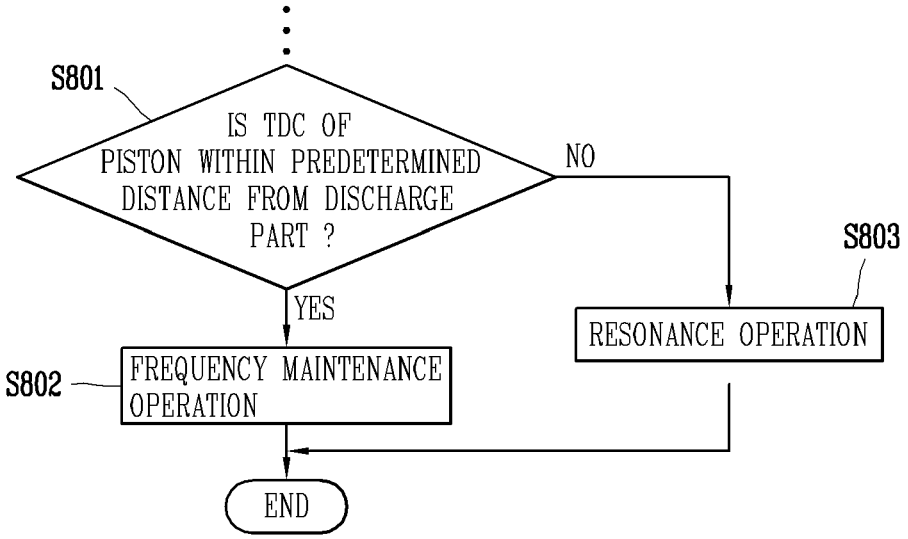

Referring to FIG. 8, the controller 25 may determine whether to perform the resonance operation based on information related to a motion or movement of the piston.

In detail, the controller 25 may determine whether a position where the TDC of the piston is formed is within a predetermined distance from the discharge portion of the cylinder (S801).

In addition, when the position where the TDC of the piston is formed is within the predetermined distance from the discharge portion of the cylinder, the controller 25 may terminate the resonance operation and perform the frequency maintenance operation (S802).

In some examples, when the distance between the TDC of the piston and the discharge portion of the cylinder exceeds the predetermined distance, the controller 25 may perform the resonance operation (S803).

Figure 9:
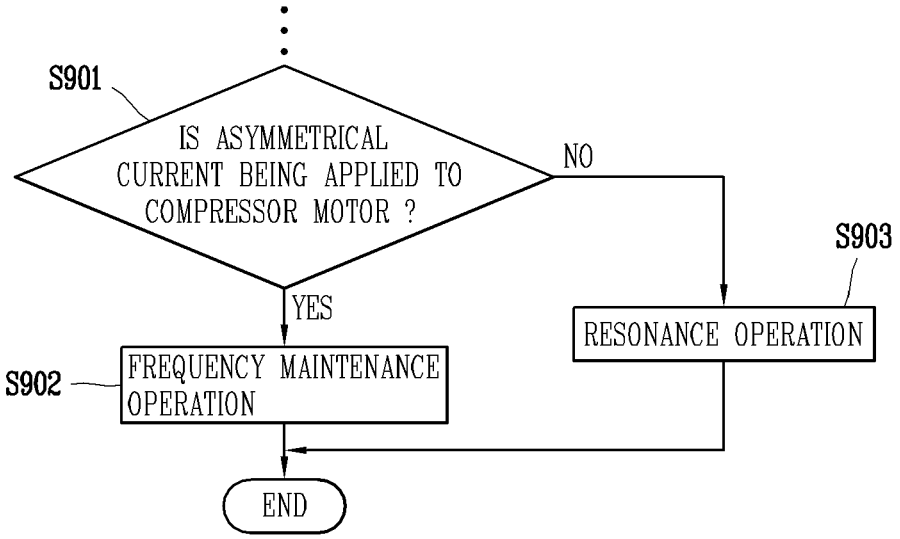

Referring to FIG. 9, the controller 25 may determine whether to perform the resonance operation based on a waveform of a motor current applied to the motor.

In detail, the controller 25 may determine whether an asymmetric current is applied to the motor (S901).

When the asymmetrical current is applied to the motor, the controller 25 may maintain the operating frequency of the motor (S902). In some examples, when a symmetrical current is applied to the motor, the controller 25 may perform the resonance operation (S903).

In some implementations, the controller 25 may determine whether to perform the resonance operation based on a waveform of a motor voltage applied to the motor. That is, the controller 25 may determine whether to perform the resonance operation according to whether or not the asymmetric voltage is applied to the motor. For instance, the controller 25 may determine the asymmetrical voltage based on a reference voltage when the motor voltage has a magnitude greater in one side of the reference voltage than in the other side of the reference voltage.

Figure 10:
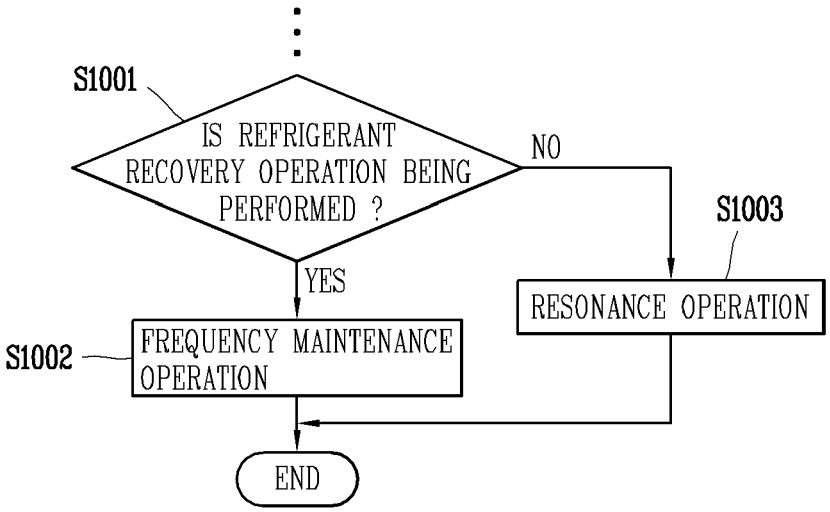

Referring to FIG. 10, when a refrigerant cycle system including the linear compressor performs a refrigerant recovery operation, the controller 25 may terminate the resonance operation and maintain the operating frequency of the motor.

In detail, the controller 25 may determine whether the compressor is performing a refrigerant recovery operation (S1001). In addition, when the compressor is performing the refrigerant recovery operation, the controller 25 may terminate the resonance operation and perform the frequency maintenance operation (S1002).

Figure 11:
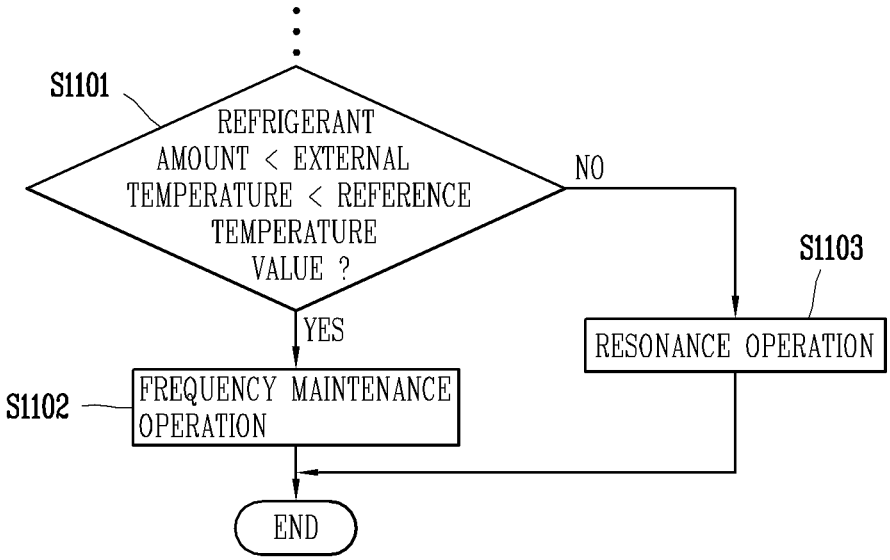

Referring to FIG. 11, the controller 25 may determine whether to perform the resonance operation based on an amount of refrigerant circulating in a refrigerant cycle system or based on an external temperature.

In detail, the controller 25 may determine whether an amount of refrigerant is smaller than a reference refrigerant amount or whether an external temperature is lower than a reference temperature value (S1101). In addition, when the amount of refrigerant is smaller than the reference refrigerant amount or the external temperature is lower than the reference temperature value, the controller 25 may terminate the resonance operation and perform the frequency maintenance operation (S1102).

Figure 12:
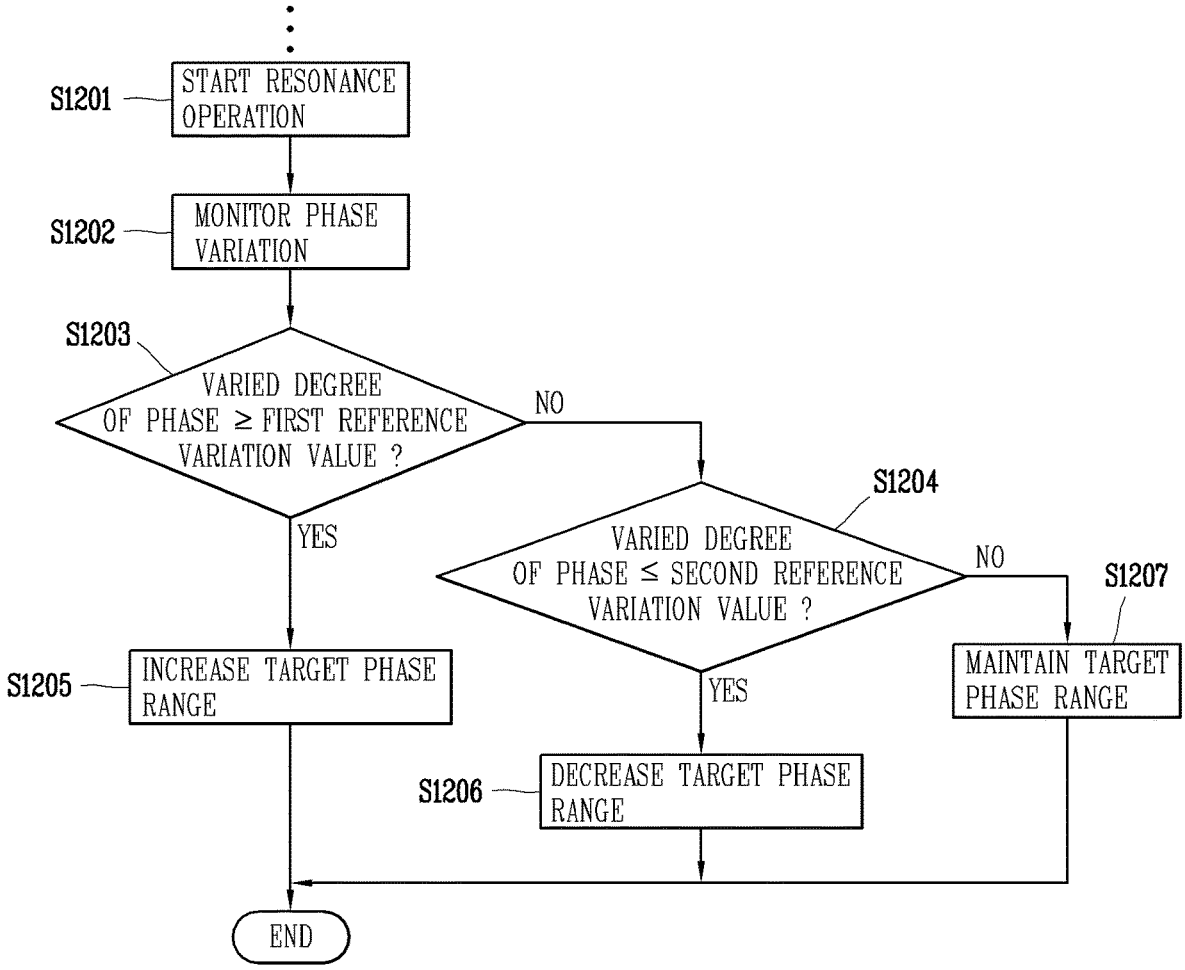

Referring to FIG. 12, a method of varying a target phase associated with a resonance operation is described.

After the resonance operation is started (S1201), the controller 25 may monitor a variation of a phase difference between a motor current and a stroke (S1202).

If a variation value (or a varied degree) of the phase difference is greater than or equal to a first reference variation value, the controller 25 may increase a target phase range (S1205). When the variation value (or varied degree) of the phase difference is smaller than or equal to a second reference variation value, the controller 25 may decrease the target phase range (S1206).

In some examples, when the variation value of the phase difference is smaller than the first reference variation value and exceeds the second reference variation value, the controller 25 may maintain the target phase range (S1207).

In some implementations, the linear compressor may include a controller to estimate a stroke of a piston using a motor current and a motor voltage, and calculate a phase difference between the stroke and the motor current. For example, the controller may detect information related to an operation of the linear compressor, select (determine) whether to perform a resonance operation based on the detected information, and control an operation of the motor in a manner that the calculated phase difference is within a preset phase range when the resonance operation is selected.

In some implementations, the information related to the operation of the linear compressor may include at least one of information related to the motor current, information related to the motor voltage, information related to an operation mode of the linear compressor, information related to a load of an apparatus having the linear compressor, and information related to a motion of the piston.

In some implementations, the controller may set an operating frequency of the motor so that the resonance operation is performed, when a freezing capacity of the linear compressor is set variably.

In some implementations, the controller may receive information related to a magnitude of the load of the apparatus having the linear compressor, from the apparatus, and set an operating frequency of the motor so that the resonance operation is performed when the magnitude of the load is smaller than a preset reference load value.

In some implementations, the controller may monitor a change in at least one of the motor current and the motor voltage, and set an operating frequency of the motor based on a result of the monitoring, so that the resonance operation is performed.

In some implementations, the controller may detect a distance between a position where a top dead center of the piston is formed and a discharge portion of the cylinder, and set an operating frequency of the motor so that the resonance operation is performed when the detected distance exceeds a preset limit distance.

In some implementations, the controller may terminate the resonance operation and maintain the operating frequency of the motor when an asymmetric current or an asymmetric voltage is applied to the motor.

In some implementations, the controller may terminate the resonance operation and maintain the operating frequency of the motor when the linear compressor is performing a refrigerant recovery operation.

In some implementations, the controller may detect the position where the top dead center of the piston is formed based on the calculated phase difference and the motor current, and terminate the resonance operation and maintain the operating frequency of the motor when the position where the top dead center of the piston is formed is detected.

In some implementations, the controller may maintain the operating frequency of the motor for a predetermined time interval from a time point that the position where the top dead center of the piston is formed has been detected.

In some implementations, the controller may maintain the operating frequency of the motor for a preset time interval from a time point that the operation of the linear compressor is started, and set the operating frequency of the motor variably so that the linear compressor performs the resonance operation when the time interval elapses.

In some implementations, the controller may receive temperature information related to a position, at which an apparatus having the linear compressor is installed, from the apparatus, and maintain the operating frequency of the motor when it is determined based on the temperature information that the temperature of the installed position of the apparatus is lower than or equal to a preset reference temperature.

According the present disclosure, a linear compressor can be controlled to operate with a resonant phase by way of varying a frequency. Accordingly, a phase can change even by less power consumption, thereby enhancing compressor efficiency.

In addition, the linear compressor can be controlled to operate with a resonant phase by way of changing an initial value of a piston using an electric control, thereby enhancing compressor efficiency and overcoming a limit in a mechanical design.

According to the present disclosure, enhancement of compressor efficiency can be maximized by varying a frequency to change a phase and changing an initial value of the piston when reaching a frequency change limit.

What is claimed is:

1. A linear compressor comprising:

a cylinder;

a piston configured to reciprocate inside the cylinder;

a motor configured to supply driving force to the piston;

a detector configured to detect a motor current and a motor voltage that are applied to the motor; and a controller configured to estimate a stroke of the piston based on the motor current and the motor voltage and to determine a phase difference between the stroke and the motor current, wherein the controller is configured to:

detect operation information of the linear compressor, determine an operation condition of the linear compressor based on the detected operation information, compare the operation condition with a predetermined condition, determine whether to perform a resonance operation based on a result of comparing the operation condition with the predetermined condition, and control operation of the motor to allow the phase difference to be within a preset phase range, wherein the operation information of the linear compressor includes at least one of information related to the motor current, information related to the motor voltage, information related to an operation mode of the linear compressor, information related to a load applied to an apparatus having the linear compressor, or information related to a motion of the piston, wherein the controller is further configured to:

based on determining that the operation condition does not correspond to the predetermined condition, determine whether to detect a top dead center of the piston based on the operation information, the top dead center corresponding to a position at which the piston changes a direction of reciprocation, perform the resonance operation based on determining that the operation condition corresponds to the predetermined condition, calculate a phase difference variable by subtracting the phase difference from 180°, compare the phase difference variable with a preset reference phase value, and change an operating frequency of the motor based on a comparison result of the phase difference variable with the preset reference phase value.

2. The linear compressor of claim 1, wherein the controller is configured to:

determine whether a capacity of the linear compressor is variably set; and set the operating frequency of the motor for the resonance operation based on determining that the capacity of the linear compressor is variably set.

3. The linear compressor of claim 1, wherein the controller is configured to:

determine whether a capacity of the linear compressor is variably set; and based on determining that the capacity of the linear compressor is not variably set, maintain the operating frequency of the motor at a maximum frequency or increase the operating frequency of the motor to the maximum frequency.

4. The linear compressor of claim 1, wherein the controller is configured to:

receive, from the apparatus having the linear compressor, information related to a load magnitude corresponding to the load applied to the apparatus; and set the operating frequency of the motor for the resonance operation based on the load magnitude being less than a preset reference load value.

5. The linear compressor of claim 1, wherein the controller is configured to:

receive, the apparatus having the linear compressor, information related to a load magnitude corresponding to the load applied to the apparatus; and increase the operating frequency of the motor to a preset reference frequency or higher based on the load magnitude being greater than or equal to a preset reference load value.

6. The linear compressor of claim 1, wherein the controller is configured to:

monitor a change of at least one of the motor current or the motor voltage; and set the operating frequency of the motor for the resonance operation based on the change of the at least one of the motor current or the motor voltage.

7. The linear compressor of claim 1, wherein the controller is configured to:

detect a distance between the top dead center of the piston and a discharge portion of the cylinder configured to discharge refrigerant; and set the operating frequency of the motor for the resonance operation based on the detected distance exceeding a preset limit distance.

8. The linear compressor of claim 1, wherein the controller is configured to:

determine whether the motor current corresponds to an asymmetrical current with respect to a reference current or the motor voltage corresponds to an asymmetrical voltage with respect to a reference voltage; and based on determining that at least one of the asymmetrical current or the asymmetrical voltage is applied to the motor, terminate the resonance operation and maintain the operating frequency of the motor.

9. The linear compressor of claim 1, wherein the controller is configured to:

determine whether the motor current corresponds to an asymmetrical current with respect to a reference current or the motor voltage corresponds to an asymmetrical voltage with respect to a reference voltage; and set the operating frequency of the motor for the resonance operation based on determining that the asymmetrical current and the asymmetrical voltage are not applied to the motor.

10. The linear compressor of claim 1, wherein the controller is configured to, based on the operation information corresponding to a refrigerant recovery operation, terminate the resonance operation and maintain the operating frequency of the motor.

11. The linear compressor of claim 1, wherein the controller is configured to:

determine an amount of refrigerant circulated by the linear compressor; and based on the amount of refrigerant being less than a reference refrigerant amount, terminate the resonance operation and maintain the operating frequency of the motor.

12. The linear compressor of claim 1, wherein the controller is configured to:

determine the top dead center of the piston based on the phase difference and the motor current; and based on detecting that the piston is disposed at the top dead center, terminate the resonance operation and maintain the operating frequency of the motor.

13. The linear compressor of claim 12, wherein the controller is configured to maintain the operating frequency of the motor for a predetermined time interval from a time point corresponding to the detection of the position of the piston corresponding to the top dead center.

14. The linear compressor of claim 1, wherein the controller is configured to:

maintain operating frequency of the motor for a predetermined time interval from a time point corresponding to a start of operation of the linear compressor; and based on an elapse of the predetermined time interval from the time point, variably set the operating frequency of the motor for the resonance operation.

15. The linear compressor of claim 1, wherein the controller is configured to:

receive, from the apparatus having the linear compressor, temperature information related to a temperature corresponding to a location where the apparatus is installed; and maintain the operating frequency of the motor based on determining, from the temperature information, that the temperature is less than or equal to a preset reference temperature.

16. The linear compressor of claim 1, wherein the controller is configured to:

monitor a variation of the phase difference after the resonance operation is started; and vary the preset phase range according to the variation of the phase difference.

17. The linear compressor of claim 16, wherein the controller is configured to increase the preset phase range to a target phase range based on the variation of the phase difference corresponding to a value that is greater than or equal to a preset first reference variation value.

18. The linear compressor of claim 16, wherein the controller is configured to decrease the preset phase range to a target phase range based on the variation of the phase difference corresponding to a value that is less than or equal to a preset second reference variation value.

19. The linear compressor of claim 16, wherein the controller is configured to decrease the preset phase range to a target phase range based on the variation of the phase difference corresponding to a value that is less than a preset first reference variation value and exceeds a preset second reference variation value.

20. The linear compressor of claim 1, wherein the controller is further configured to:

increase the operating frequency of the motor based on the phase difference variable being greater than the preset reference phase value; and decrease the operating frequency of the motor based on the phase difference variable being less than a lower limit reference phase value.

* * * * *